US006914588B2

(12) United States Patent
Tsai

(10) Patent No.: US 6,914,588 B2
(45) Date of Patent: Jul. 5, 2005

(54) TWO TFT PIXEL STRUCTURE LIQUID CRYSTAL DISPLAY

(75) Inventor: Chu-Hung Tsai, Kao-Hsiung (TW)

(73) Assignee: Quanta Display Inc., Tao-Yuan Hsien (TW)

( * ) Notice: Subject to any disclaimer, the term of this patent is extended or adjusted under 35 U.S.C. 154(b) by 272 days.

(21) Appl. No.: 10/249,455

(22) Filed: Apr. 11, 2003

(65) Prior Publication Data

US 2004/0160403 A1 Aug. 19, 2004

(30) Foreign Application Priority Data

Feb. 14, 2003 (TW) ..... 92103165 A

(51) Int. Cl.[7] ..... G09G 3/36

(52) U.S. Cl. ..... 345/92; 345/87; 345/90; 345/96; 345/98

(58) Field of Search ..... 345/87, 90, 91, 345/92, 93, 96, 98, 204; 341/1, 33–34, 41–47

(56) References Cited

U.S. PATENT DOCUMENTS 4,690,509 A * 9/1987 Bohmer ..... 345/89
5,617,229 A * 4/1997 Yamamoto et al. ..... 349/42
5,712,652 A * 1/1998 Sato et al. ..... 345/90

* cited by examiner

*Primary Examiner*—Vijay Shankar
(74) *Attorney, Agent, or Firm*—Winston Hsu

(57) ABSTRACT

A two TFT pixel structure liquid crystal display includes a first and a second scan line, a first and a second signal line, and a pixel. The pixel includes a pixel electrode and a first and a second transistor. A gate of the first and the second transistor is electrically connected to the first and the second scan line respectively. A source of the first and the second transistor is electrically connected to the first and the second signal line respectively. The drains of the first and the second transistor are electrically connected to the pixel electrode. The ratio of the channel width to the channel length of the first transistor is less than the ratio of the channel width to the channel length of the second transistor.

12 Claims, 8 Drawing Sheets

TWO TFT PIXEL STRUCTURE LIQUID CRYSTAL DISPLAY

BACKGROUND OF INVENTION

1. Field of the Invention

The present invention relates to a two thin film transistor pixel structure liquid crystal display (two TFT pixel structure LCD), and more particularly, to a liquid crystal display having high resolution and high display frequency.

2. Description of the Prior Art

A thin film transistor liquid crystal display (TFT-LCD), utilizes many thin film transistors, in conjunction with other elements such as capacitors and bonding pads, arranged in a matrix as switches for driving liquid crystal molecules to produce brilliant images. Basically, the conventional TFT-LCD includes a transparent substrate having a matrix of thin film transistors, pixel electrodes, scan lines, signal lines orthogonal to the scan lines, a color filter, and liquid-crystal materials between the transparent substrate and the color filter. With the supporting electrical devices, the TFT-LCD devicedrives liquid-crystal-pixels to generate color-rich graphics. Since a TFT-LCD has the advantages of being lightweight, having low energy consumption, and being free of radiation emission, the TFT-LCD is widely used in various portable products, such as notebooks, personal data assistants (PDA), etc., and even has a great potential to replace the conventional CRT monitor.

Please refer to FIG. 1 to FIG. 3. FIG. 1 is a schematic diagram of a TFT-LCD 10. FIG. 2 is an equivalent circuit diagram of a pixel 20 according to the prior art method. FIG. 3 is a top view of the pixel 20 according to the prior art. As shown in FIG. 1, The TFT-LCD 10 comprises a scanning line control circuit 12, a signal line control circuit 14, and a pixel array 16 having a plurality of pixels (not shown).

As shown in FIG. 2 and FIG. 3, each of the pixels 20 in the pixel array 16 comprises a liquid crystal unit (LC unit) 22 filled with liquid crystal molecules (not shown). The liquid crystal unit 22 is electrically connected to a common counter electrode (CE) and a thin film transistor 24. A gate electrode 26 of the thin film transistor 24 is electrically connected to a scan line Gn, a source electrode 28 of the thin film transistor 24 is electrically connected to a signal line Sn, and a drain electrode 32 of the thin film transistor 24 is electrically connected to a pixel electrode (not shown). The pixel 20 further comprises a storage capacitor (SC) electrically connected between the liquid crystal unit 22 and the common counter electrode, and a gate-drain capacitor (GD) electrically connected between the gate electrode 26 and the drain electrode 32 of the thin film transistor 24. The storage capacitor SC is used to reduce the voltage variation of the liquid crystal unit 22 due to leakage current and thus assists the liquid crystal unit 22 with storing electric charges. The gate-drain capacitor GD is a parasitic capacitor.

Please refer to FIG. 4. FIG. 4 is a schematic diagram of charging of the pixel 20 shown in FIG. 3 according to the prior art method. As shown in FIG. 4, A first voltage pulse is applied to the previous scan line $G_{n-1}$ according to the timing of the first voltage pulse, then is applied to the next scan line $G_n$ at a period immediately following when the first voltage pulse is applied to the previous scan line $G_{n-1}$ according to the timing of the first voltage pulse. At the same time, a second voltage pulse is applied to the previous signal line $S_{n+1}$ according to the timing of the second voltage pulse, then is applied to the next signal line $S_n$ at a period immediately following when the second voltage pulse is applied to the previous signal line $S_{n+1}$ according to the timing of the second voltage pulse. When the first voltage pulse and the second voltage pulse are respectively applied to the scan line $G_n$ and the signal line $S_n$ simultaneously, the thin film transistor 24 is turned on to charge the pixel electrode (not shown). The pixel voltage thus rises to rotate the liquid crystal molecules (not shown) filled in the liquid crystal unit (not shown) in the pixel 20 to expected angles to control the amount of light passing through the pixel 20.

In order to be compatible with the spec of high resolution and high frequency, the quantities of the scan lines and the signal lines must be much increased. When the quantities of the scan lines and the signal lines are increased significantly, the charging time ($T_{on}$) of each of the pixel is shortened. Since driving the rotation of the liquid crystal molecules requires a pixel voltage of a specific magnitude, insufficient charging time results in an insufficient pixel voltage. Therefore, the electric field is not able to drive the rotation of the liquid crystal molecules to expected angles to affect the amount of light passing through each pixel. Moreover, a ruined device is produced.

The prior art method to resolve this problem is to increase the ratio of the channel width to the channel length (W/L value). By increasing the ratio of the channel width to the channel length, the amount of the current flowing through the channel of the thin film transistor is increased. The time required to reach the same pixel voltage is shortened to avoid the problem of being unable to reach the expected luminosity voltage due to insufficient charging time.

However, the prior art method incurs other problems. Please refer to FIG. 5. FIG. 5 is a schematic diagram of a gate-drain capacitor being formed in a thin film transistor 60 in a prior art liquid crystal display. As shown in FIG. 5, a gate electrode 62 and a drain electrode 64 of the thin film transistor 60 are both composed of conductive materials, and the gate electrode 62 and the drain electrode 64 are isolated by insulating material (not shown). Therefore, a parasitic gate-drain capacitor GD is formed at an overlapping region 66 existing between the gate electrode 62 and the drain electrode 64 of the thin film transistor 60. When the ratio of the channel width to the channel length of the thin film transistor 60 is increased, the capacitance value ($C_{gd}$) of the gate-drain capacitance is increased.

Please refer back to FIG. 2. The voltage applied to the liquid crystal unit 22 is the difference between the voltage of the common counter electrode and the voltage of the pixel electrode. When the thin film 24 transistor is turned off, the pixel electrode (not shown) is on a floating status because the pixel electrode (not shown) is not connected to any voltage source. If any fluctuations occur in the voltages of electric elements around the pixel electrode (not shown), the fluctuations will cause the voltage of the pixel electrode (not shown) to deviate from its desirable voltage due to the coupling effect of the parasitic capacitor. The deviation of the voltage of the pixel electrode is referred to feed-through voltage ($V_{FD}$), which is represented by:

$$V_{FD}=[C_{GD}/(C_{LC}+C_{SC}+C_{GD})]*\Delta V_G \quad (1)$$

where $C_{LC}$ is the capacitance value of the liquid crystal unit 22, $C_{SC}$ is the capacitance value of the storage capacitor SC, $C_{GD}$ is the capacitance value of the gate-drain capacitor of the thin film transistor 24, and $\Delta V_G$ is the amplitude of a pulse voltage applied to the scan line. When the ratio of the channel width to the channel length of the thin film transistor 60 is increased, the capacitance value of the gate-drain capacitor is increased to contribute to the variation of the value of $V_{FD}$. Especially when a large sized liquid crystal display is fabricated, the existing process exposes the large panel, which is divided into several divisions, in turn. Under this circumstance, different deviations occur when aligning all of the divisions during the exposing procedure. Besides this, the effect of the increased ratio of the channel width to the channel length is a negative factor. Therefore, stitching defect occurs readily to result in shot mura phenomenon on the liquid crystal display, thus becoming an obstacle in processing.

Therefore, it is very important to develop a liquid crystal display having high resolution and high display frequency to resolve the problem of overly short charging time and to avoid the shot muraphenomenon because of the increased capacitance value of the gate-drain capacitor.

SUMMARY OF INVENTION

It is therefore a primary objective of the claimed invention to provide a two thin film transistor pixel structure liquid crystal display (two TFT pixel structure LCD), especially a liquid crystal display having high resolution and high display frequency.

According to the claimed invention, a liquid crystal display having high display frequency comprises at least one first scan line, at least one second scan line, at least one first signal line, at least one second signal line, and at least one pixel. The pixel is electrically connected to the first scan line, the second scan line, the first signal line, and the second signal line. The pixel comprises a liquid crystal cell filled with a plurality of liquid crystal molecules, a pixel electrode, a first switching transistor used for controlling charging of the pixel electrode, and a second switching transistor used for controlling charging of the pixel electrode.

A gate electrode of the first switching transistor is electrically connected to the first scan line, a source electrode of the first switching transistor is electrically connected to the first signal line, and a drain electrode of the first switching transistor is electrically connected to the pixel electrode. A gate electrode of the second switching transistor is electrically connected to the second scan line, a source electrode of the second switching transistor is electrically connected to the second signal line, and a drain electrode of the second switching transistor is electrically connected to the pixel electrode. The first switching transistor has a first channel length ($L_1$) and a first channel width ($W_1$) the second switching transistor has a second channel length ($L_2$) and a second channel width ($W_2$) and a ratio of the first channel width to the first channel length ($W_1/L_1$) is less than a ratio of the second channel width to the second channel length (W2/L2).

It is an advantage that the claimed liquid crystal display pre-charges the pixel electrode when the previous scan line and the previous signal line receive the voltage pulses by adding a thin film transistor. When the next scan line and the next signal line receives the voltage pulses, the pixel electrode is charged continuously so that the pixel voltage rises to an expected voltage value. Not only is the charging time of each pixel increased from $T_{on}$ to $2T_{on}$, but also the display quality is not affected. The problem of light defect is thus avoided. Moreover, the present invention is not limited to increasing the ratio of the channel width to the channel length of the thin film transistor, which is adapted in the prior art to fulfill the spec of high resolution and high display frequency. Therefore, the capacitance value of the gate-drain capacitor is not increased to greatly reduce the feed-through voltage. When applying the present invention to a practical production line, large sized panels having high resolution and high display frequency and being free from shot mura are fabricated.

These and other objectives of the claimed invention will no doubt become obvious to those of ordinary skill in the art after reading the following detailed description of the preferred embodiment, which is illustrated with figures and drawings.

DETAILED DESCRIPTION

Figure 1:
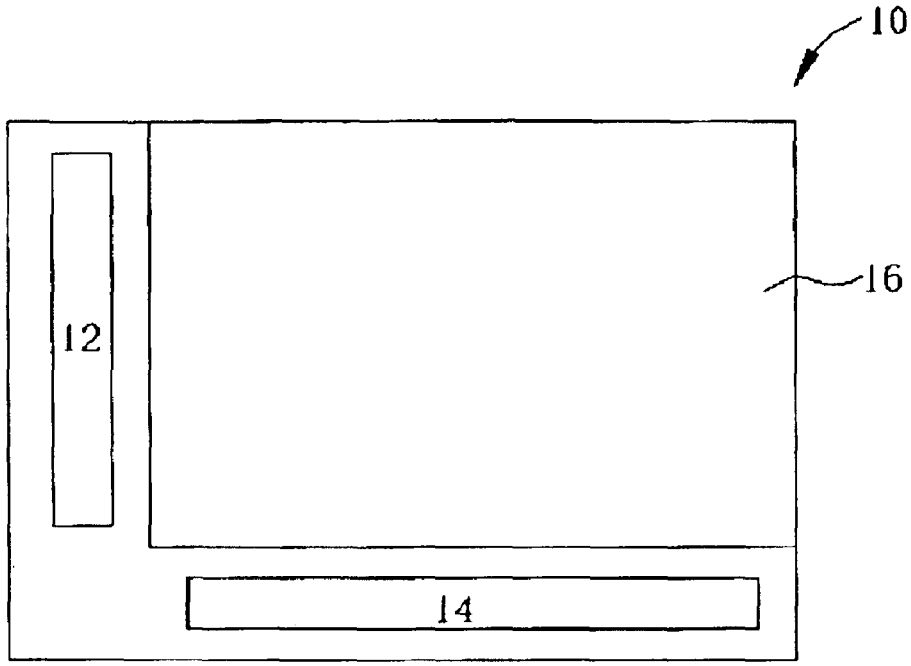
Fig. 1 Prior art
FIG. 1 is a schematic diagram of a TFT-LCD.
Figure 2:
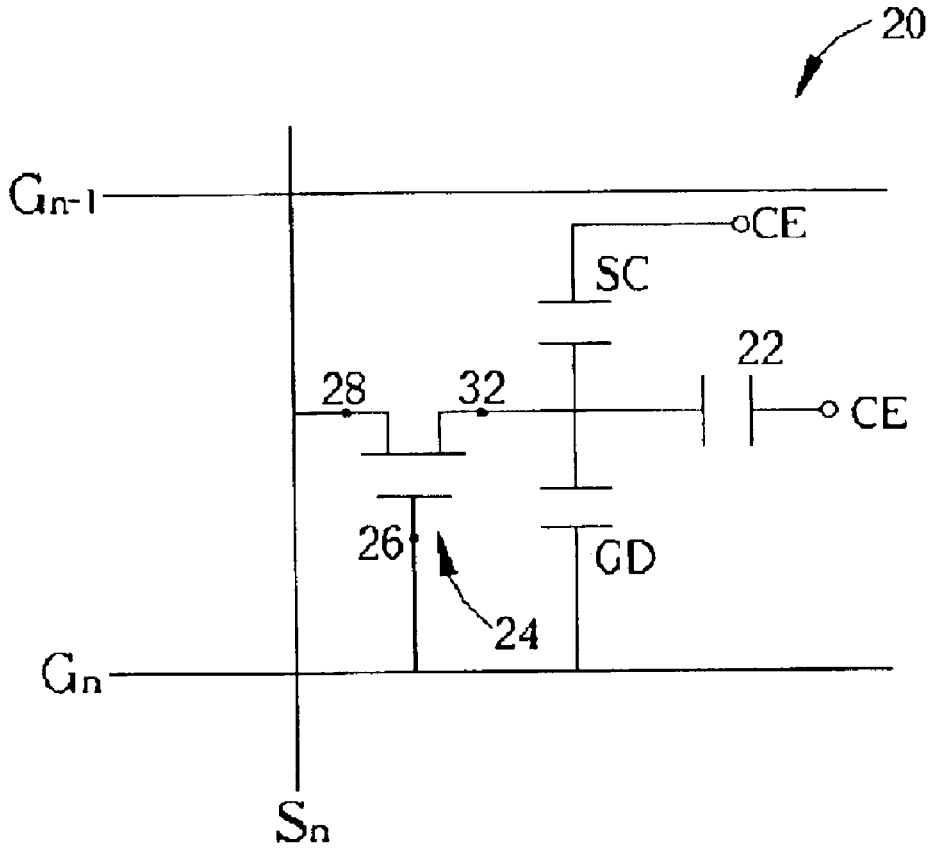
Fig. 2 Prior art
FIG. 2 is an equivalent circuit diagram of a pixel according to the prior art method.
Figure 3:
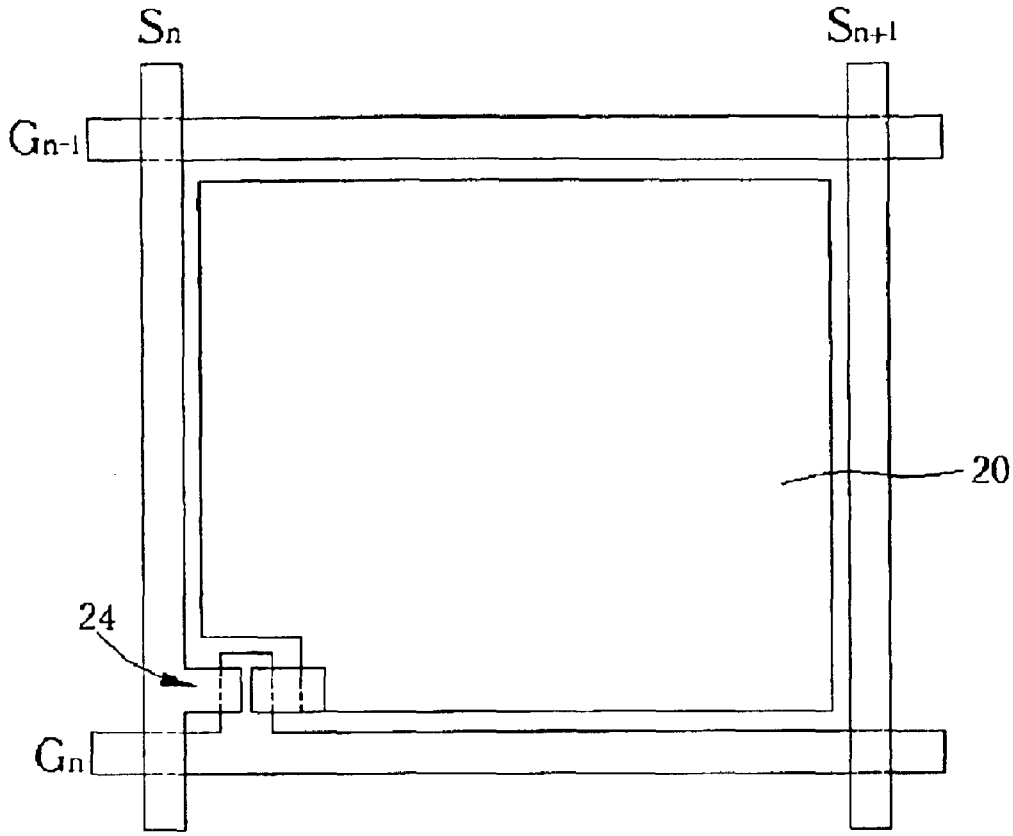
Fig. 3 Prior art
FIG. 3 is a top view of the pixel according to the prior art.
Figure 4:
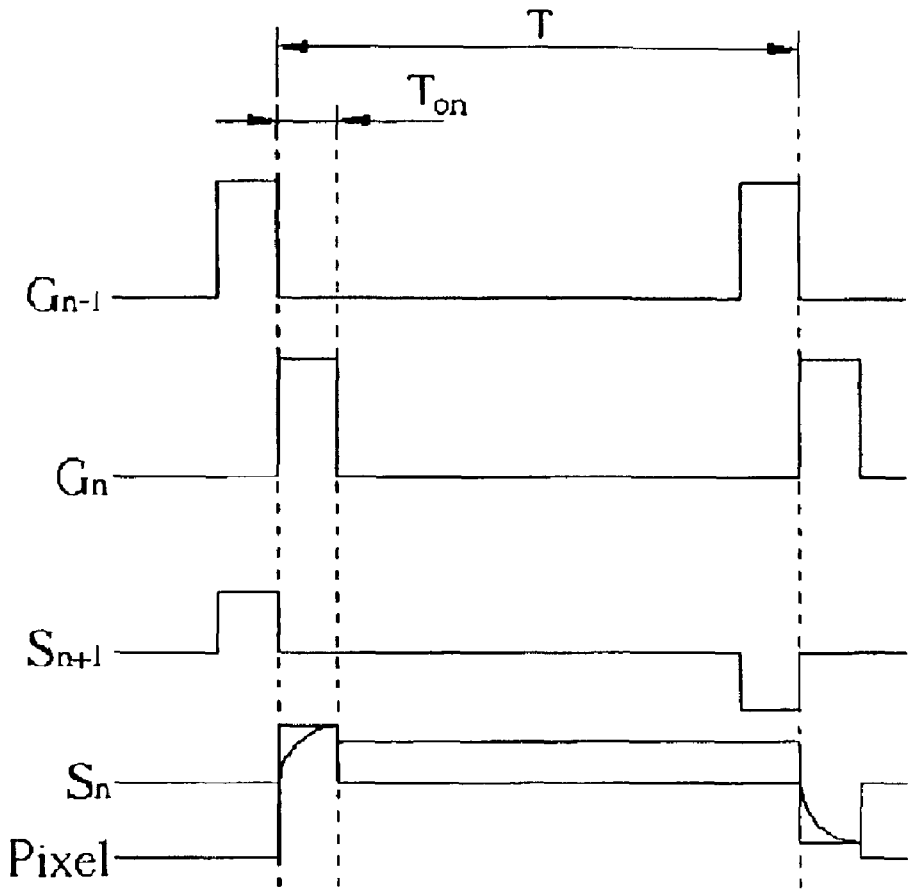
Fig. 4 Prior art
FIG. 4 is a schematic diagram of charging of the pixel shown in FIG. 3 according to the prior art method.
Figure 5:
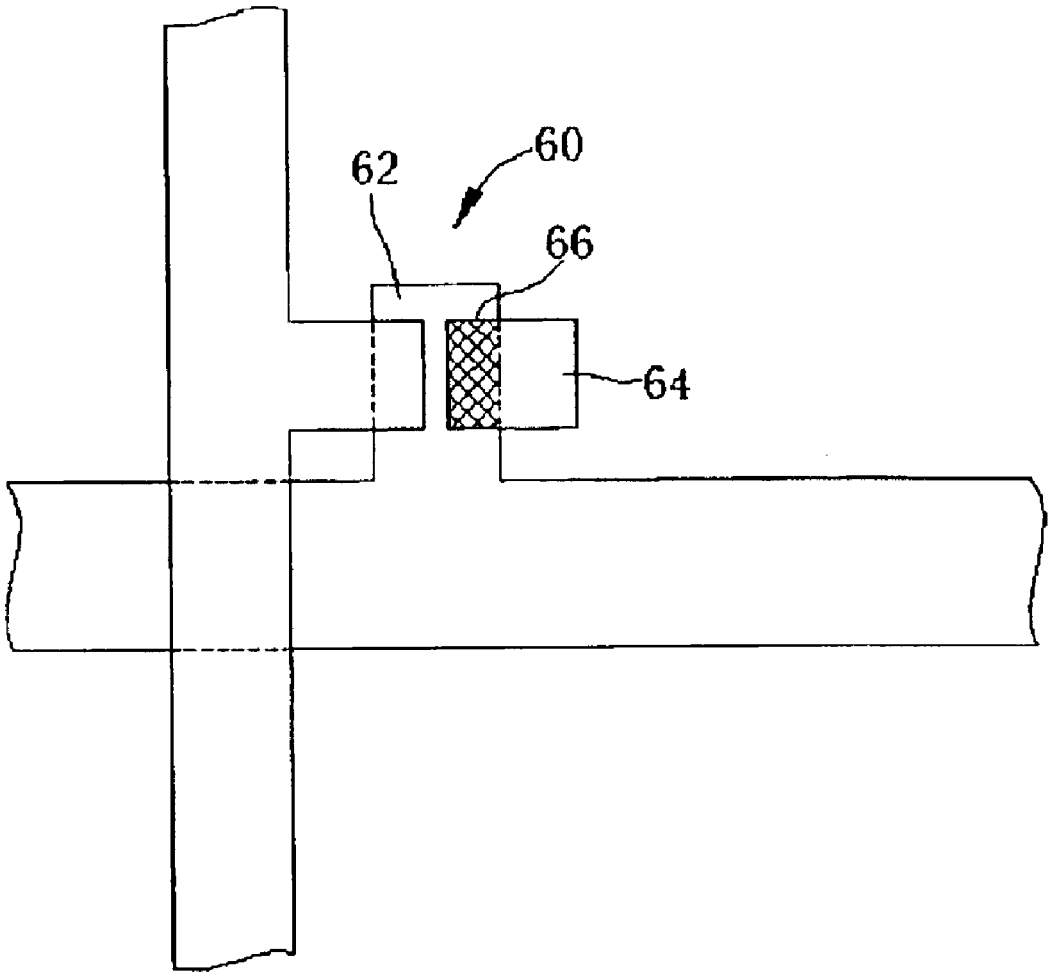
Fig. 5 Prior art
FIG. 5 is a schematic diagram of a gate-drain capacitor being formed in a thin film transistor in a prior art liquid crystal display.
Figure 6:
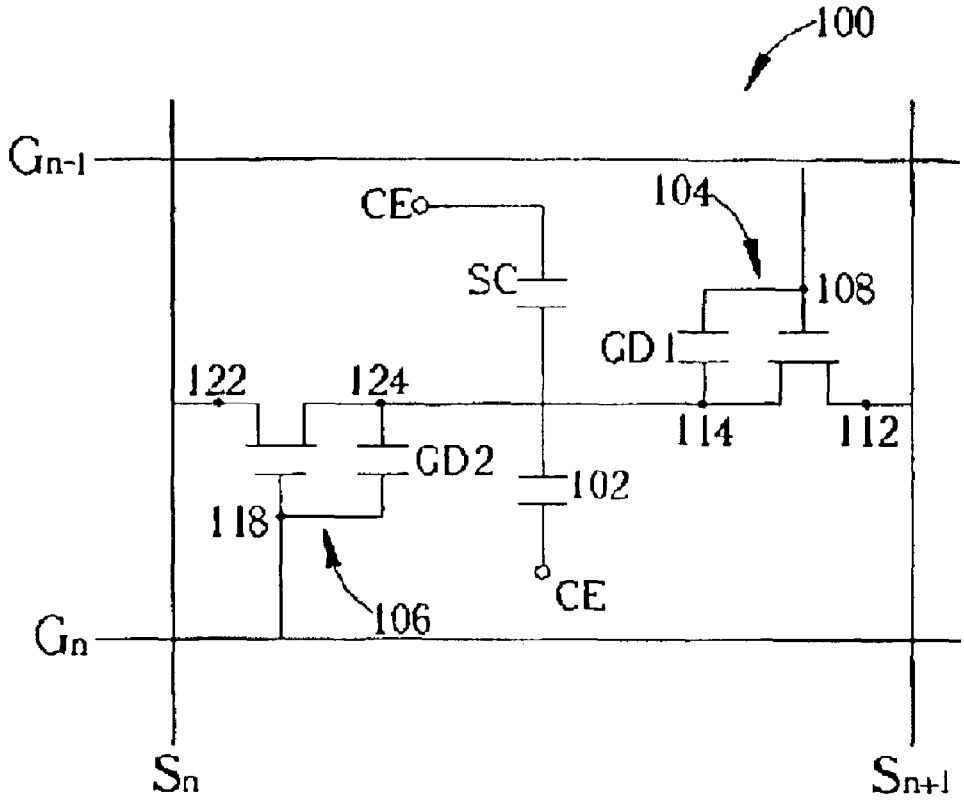
FIG. 6 is an equivalent circuit diagram of each pixel according to the present invention.
Figure 7:
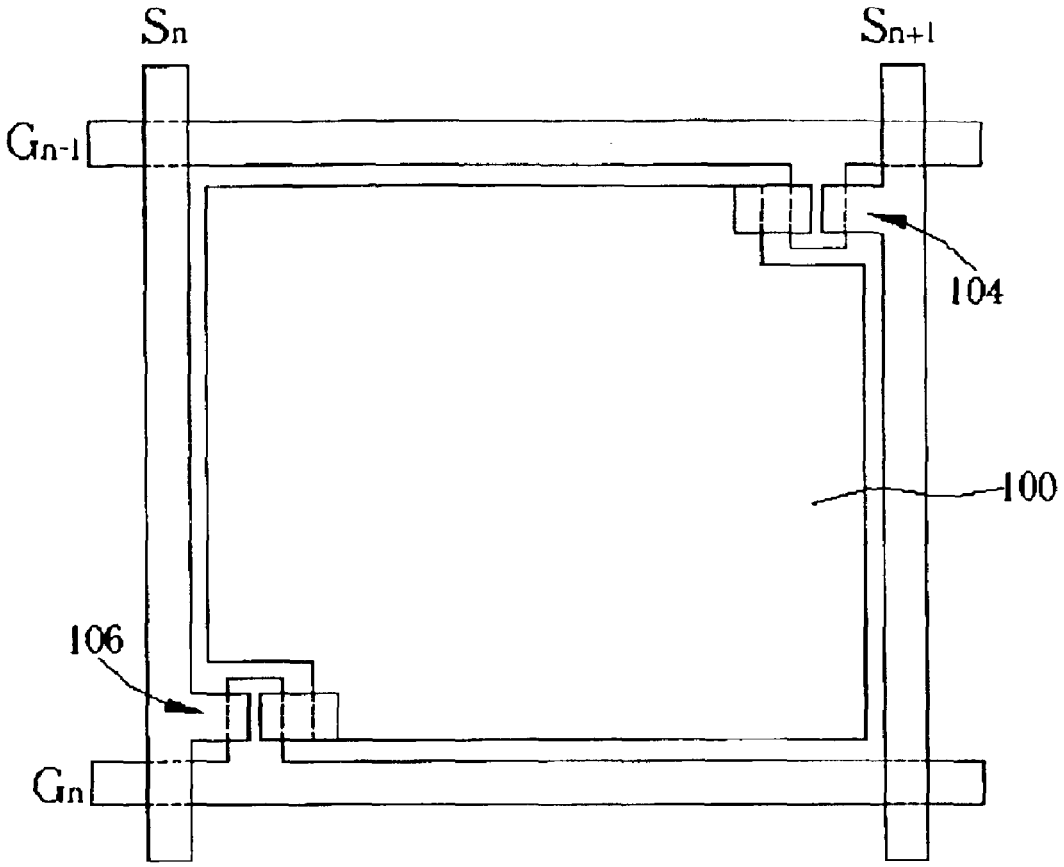
FIG. 7 is a top view of each pixel according to the present invention.

Please refer to FIG. 6 and FIG. 7. FIG. 6 is an equivalent circuit diagram of each pixel 100 according to the present invention. FIG. 7 is a top view of each pixel 100 according to the present invention. As shown in FIG. 6 and FIG. 7, each pixel 100 comprises a liquid crystal unit (LC unit) 102 filled with liquid crystal molecules (not shown), a pixel electrode (not shown), a first thin film transistor (first TFT) 104, and a second thin film transistor (second TFT) 106. The liquid crystal unit 102 is electrically connected to a common counter electrode. Both the first thin film transistor 104 and the second thin film transistor 106 are used as switches to control the charging of the pixel electrode (not shown).

A gate electrode 108 of the first thin film transistor 104 is electrically connected to a previous scan line $G_{n-1}$ a source electrode 112 of the first thin film transistor 104 is electrically connected to a previous signal line $S_{n+1}$, and a drain electrode 114 of the first thin film transistor 104 is electrically connected to the pixel electrode (not shown). A gate electrode 118 of the second thin film transistor 106 is electrically connected to a next scan line $G_n$, a source electrode 122 of the second thin film transistor 106 is electrically connected to a next signal line $S_n$, and a drain electrode 124 of the second thin film transistor 106 is electrically connected to the pixel electrode (not shown).

It is worth noticing that the first thin film transistor 104 has a first channel length ($L_1$) and a first channel width ($W_1$), and the second thin film transistor 106 has a second channel length ($L_2$) and a second channel width ($W_2$). A ratio of the first channel width to the first channel length ($W_1/L_1$) is less than a ratio of the second channel width to the second channel length ($W_2/L_2$). In addition, the pixel 100 comprises at least one storage capacitor SC. In FIG. 6, a storage capacitor SC is electrically connected between the liquid crystal unit 102 and the common counter electrode, which is frequently seen.

An overlapping region (not shown) existing between the gate electrode 108 and the drain electrode 114 of the first thin film transistor 104 results in a first gate-drain capacitor GD1, which is electrically connected between the gate electrode 108 and the drain electrode 114 of the first thin film transistor 104. An overlapping region (not shown) existing between the gate electrode 118 and the drain electrode 124 of the second thin film transistor 106 results in a second gate-drain capacitor GD2, which is electrically connected between the gate electrode 118 and the drain electrode 124 of the second thin film transistor 106. The storage capacitor SC is used to reduce the voltage variation of the liquid crystal unit 102 due to leakage current and thus assists the liquid crystal unit 102 with storing electric charges. The first gate-drain capacitor GD1 and the second gate-drain capacitor GD2 are both parasitic capacitors.

Figure 8:
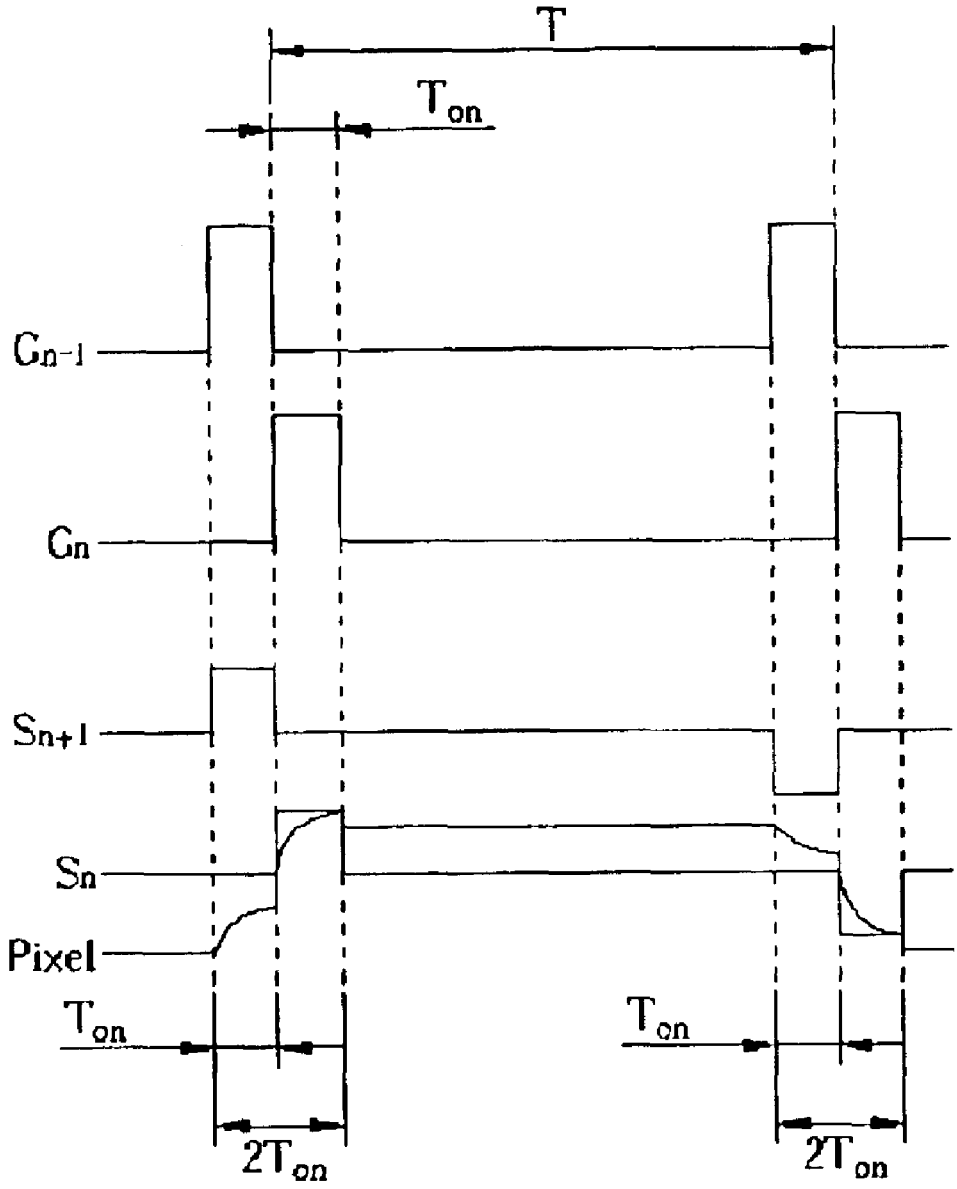
FIG. 8 is a schematic diagram of charging of the pixel shown in FIG. 7 according to the present invention.

Please refer to FIG. 8. FIG. 8 is a schematic diagram of charging of the pixel 100 shown in FIG. 7 according to the present invention. As shown in FIG. 8, a first voltage pulse is applied to the previous scan line $G_{-1}$ according to the timing of the first voltage pulse, and then is applied to the next scan line $G_n$ at a period immediately following when the first voltage pulse is applied to the previous scan line $G_{n-1}$ according to the timing of the first voltage pulse. Similarly, a second voltage pulse is applied to the previous signal line $S_{-1}$ according to the timing of the second voltage pulse, and then is applied to the next signal line $S_n$ at a period immediately following when the second voltage pulse is applied to the previous signal line $S_{n+1}$ according to the timing of the second voltage pulse. When the first voltage pulse and the second voltage pulse are respectively applied to the scan line $G_{n-1}$ and the signal line $S_{n+1}$ simultaneously, the first thin film transistor 104 is turned on to charge the pixel electrode (not shown). The pixel voltage thus rises to a certain value.

When the first voltage pulse and the second voltage pulse are respectively applied to the scan line $G_n$ and the signal line $S_n$ simultaneously, the second thin film transistor 106 is turned on to continuously charge the pixel electrode (not shown). The pixel voltage keeps rising to drive the rotating of the liquid crystal molecules (not shown) filled in the liquid crystal unit (not shown) in the pixel 100 to expected angles to control the amount of light passing through the pixel 100.

When the first thin film transistor 104 is turned on, the pixel 100 is charged. In other words, when the first voltage pulse is applied to the previous scan line $G_{n-1}$ and the second voltage pulse is applied to the previous signal line $S_{n+1}$ the pixel voltage starts rising to a certain value. When the first voltage pulse is applied to the next scan line $G_n$ and the second voltage pulse is applied to the next signal line $S_n$, the pixel voltage rises to the expected voltage value rapidly. In short, the charging time of each pixel is increased from $T_{on}$ to $2T_{on}$ in the present invention. Since the charging time of each pixel is elongated to two times, the display frequency of the present invention liquid crystal display is obviously increased when the high resolution spec is fulfilled.

Furthermore, because the ratio of the first channel width to the first channel length ($W_1/L_1$) is less than the ratio of the second channel width to the second channel length ($W_2/L_2$), the charging rate of the second thin film transistor 106 is much greater than the charging rate of the first thin film transistor 104. Owing to the very short period of time of the charging time $2T_{on}$, the display quality will not deteriorate because the first thin film transistor 104 is turned on to pre-charge the pixel electrode at the pre pump stage, which is the duration when the first voltage pulse and the second voltage pulse are respectively applied to the previous scan line $G_{n-1}$ and the previous signal line $S_{n+1}$.

It is worth noticing that since the first thin film transistor 104 and the second thin film transistor 106 are both utilized for charging the pixel electrode (not shown), the phenomenon of light defect thus never occurs, which improves the yield, and even fabricates products having zero defects. The reason is that when one of the transistors is out of order, another transistor can be utilized for charging. By utilizing the first thin film transistor 104 to pre pump the pixel electrode, the charging time of the present invention liquid crystal display is elongated. Therefore, it is not necessary to increase the ratio of the channel width to the channel length of the second thin film transistor 106 ($W_2/L_2$), which is adapted in the prior art, to resolve the problem of being unable to reach the luminosity voltage. As a result, the capacitance value ($C_{GD2}$) of the second gate-drain capacitor GD2, formed at the overlapping region between the gate electrode 118 and the drain electrode 124, is not increased to reduce the feed-through voltage. Relatively speaking, the phenomenon of shot mura does not readily occur when taking into consideration the process of fabricating the present invention liquid crystal display.

In brief, the present invention liquid crystal display pre-charges the pixel electrode when the previous scan line and the previous signal line receive the voltage pulses by adding a thin film transistor. When the next scan line and the next signal line receives the voltage pulses, the pixel electrode is charged continuously so that the pixel voltage rises to an expected voltage value. Therefore, not only the charging time is increased. The capacitance value of the gate-drain capacitor is not increased.

In comparison with prior art, the present invention pre-charges the pixel electrode when the previous scan line and the previous signal line receive the voltage pulses by adding a thin film transistor. When the next scan line and the next signal line receives the voltage pulses, the pixel electrode is charged continuously so that the pixel voltage rises to an expected voltage value. Not only is the charging time of each pixel increased from $T_{on}$ to $2T_{on}$, but also the display quality is not affected. The problem of light defects is thus avoided. In addition, the present invention is not limited to increasing the ratio of the channel width to the channel length of the thin film transistor, which is adapted in the prior art to fulfill the spec of high resolution and high display frequency. Therefore, the capacitance value of the gate-drain capacitor is not increased to greatly reduce the feed-through voltage. When applying the present invention to a practical production line, large sized panels having high resolution and high display frequency and being free from shot mura are fabricated.

Those skilled in the art will readily observe that numerous modifications and alterations of the device may be made while retaining the teachings of the invention. Accordingly, the above disclosure should be construed as limited only by the metes and bounds of the appended claims.

What is claimed is:

1. A liquid crystal display (LCD) having high display frequency comprising:

at least one first scan line;

at least one second scan line;

at least one first signal line;

at least one second signal line; and at least one pixel being electrically connected to the first scan line, the second scan line, the first signal line, and the second signal line, the pixel comprising:

a liquid crystal cell filled with a plurality of liquid crystal molecules;

a pixel electrode;

a first switching transistor used for controlling charging of the pixel electrode, a gate electrode of the first switching transistor being electrically connected to the first scan line, a source electrode of the first switching transistor being electrically connected to the first signal line, and a drain electrode of the first switching transistor being electrically connected to the pixel electrode; and a second switching transistor used for controlling charging of the pixel electrode, a gate electrode of the second switching transistor being electrically connected to the second scan line, a source electrode of the second switching transistor being electrically connected to the second signal line, and a drain electrode of the second switching transistor being electrically connected to the pixel electrode;

wherein the first switching transistor has a first channel length ($L_1$) and a first channel width ($W_1$), the second switching transistor has a second channel length ($L_2$) and a second channel width ($W_2$) and a ratio of the first channel width to the first channel length ($W_1/L_1$) is less than a ratio of the second channel width to the second channel length ($W_2/L_2$).

2. The liquid crystal display of claim 1 wherein when a first voltage pulse is applied to the first scan line and a second voltage pulse is applied to the first signal line, the first switching transistor is turned on to charge the pixel electrode.

3. The liquid crystal display of claim 2 wherein the second scan line receives the first voltage pulse at a period immediately following when the first scan line receives the first voltage pulse according to the timing of the first voltage pulse, and the second signal line receives the second voltage pulse at a period immediately following when the first signal line receives the second voltage pulse according to the timing of the second voltage pulse.

4. The liquid crystal display of claim 3 wherein when the first voltage pulse is applied to the second scan line and the second voltage pulse is applied to the second signal line, the second switching transistor is turned on to charge the pixel electrode.

5. The liquid crystal display of claim 1 being a two thin film transistor pixel structure liquid crystal display (two TFT pixel structure LCD).

6. The liquid crystal display of claim 5 wherein the first switching transistor and the second switching transistor are utilized for charging the pixel electrode to increase the charging time ($T_{on}$) of the pixel electrode.

7. The liquid crystal display of claim 6 wherein increasing the charging time of the pixel electrode increases the display frequency of the liquid crystal display.

8. The liquid crystal display of claim 1 wherein a first overlapping region exists between the gate electrode and the drain electrode of the first switching transistor, and a second overlapping region exists between the gate electrode and the drain electrode of the second switching transistor.

9. The liquid crystal display of claim 8 wherein the first overlapping region results in a parasitic capacitor being formed between the gate electrode and the drain electrode of the first switching transistor (parasitic GD of the first switching transistor), and the second overlapping region results in a parasitic capacitor being formed between the gate electrode and the drain electrode of the second switching transistor (parasitic GD of the second switching transistor).

10. The liquid crystal display of claim 1 wherein the first switching transistor and the second switching transistor are utilized for charging the pixel electrode to drive the rotation of each liquid crystal molecule in the liquid crystal cell.

11. The liquid crystal display of claim 1 wherein the ratio of the first channel width to the first channel length being less than the ratio of the second channel width to the second channel length makes the charging rate of the second switching transistor be greater than the charging rate of the first switching transistor.

12. The liquid crystal display of claim 1 wherein the pixel further comprises at least one storage capacitor (SC) to assist the liquid crystal cell with storing charges.

* * * * *